US010989102B2

(12) United States Patent
Han et al.

(10) Patent No.: US 10,989,102 B2
(45) Date of Patent: Apr. 27, 2021

(54) ENGINE COOLANT SEPARATOR AND ENGINE COOLING SYSTEM HAVING THE SAME

(71) Applicants: Hyundai Motor Company, Seoul (KR); Kia Motors Corporation, Seoul (KR)

(72) Inventors: Jong Wan Han, Whasung-Si (KR); Jung Hyeok Lim, Whasung-Si (KR); Yong Woong Cha, Whasung-Si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 151 days.

(21) Appl. No.: 16/160,056

(22) Filed: Oct. 15, 2018

(65) Prior Publication Data

US 2019/0309674 A1 Oct. 10, 2019

(30) Foreign Application Priority Data

Apr. 6, 2018 (KR) ..... 10-2018-0040240

(51) Int. Cl.

| | |
|---|---|
| ***F01P 11/12*** | (2006.01) |
| ***F01P 3/02*** | (2006.01) |
| ***F28F 23/02*** | (2006.01) |
| *F02F 1/10* | (2006.01) |

(52) U.S. Cl.

CPC ..... *F01P 11/12* (2013.01); *F01P 3/02* (2013.01); *F28F 23/02* (2013.01); *F01P 2003/024* (2013.01); *F02F 1/10* (2013.01)

(58) Field of Classification Search

CPC ... B01D 19/0026; B01D 19/0052; F01P 3/20; F01P 3/02; F01P 11/12; F01P 2003/024; F01P 5/10; F28F 28/02; F28F 23/02

USPC ..... 95/214, 217; 55/447, 456, 461

See application file for complete search history.

(56) References Cited

U.S. PATENT DOCUMENTS

| | | | | |
|---|---|---|---|---|
| 3,228,597 | A * | 1/1966 | Walker | H02K 7/16 494/14 |
| 3,779,452 | A * | 12/1973 | Nau | B01D 53/00 202/152 |
| 4,622,925 | A * | 11/1986 | Kubozuka | F01P 3/2271 123/41.25 |
| 4,961,404 | A * | 10/1990 | Itakura | F01P 5/10 123/41.31 |
| 5,092,282 | A * | 3/1992 | Danekas | B60H 1/08 123/41.21 |
| 6,866,092 | B1 * | 3/2005 | Molivadas | F02B 29/0475 165/104.21 |
| 7,883,570 | B2 * | 2/2011 | Obrejanu | B01D 19/0057 95/261 |
| 2003/0029394 | A1 * | 2/2003 | Miyagawa | F01P 5/10 123/41.54 |

* cited by examiner

*Primary Examiner* — Tho V Duong

(74) *Attorney, Agent, or Firm* — Morgan, Lewis & Bockius LLP

(57) ABSTRACT

An engine coolant separator may include a housing having an inlet and an outlet; and a guide member fixedly mounted inside the housing, and having a spiral channel inducing a spiral flow of an engine coolant, wherein the spiral channel communicates with the inlet of the housing.

13 Claims, 13 Drawing Sheets

ENGINE COOLANT SEPARATOR AND ENGINE COOLING SYSTEM HAVING THE SAME

CROSS-REFERENCE TO RELATED APPLICATION

The present application claims priority to Korean Patent Application No. 10-2018-0040240, filed on Apr. 6, 2018, the entire contents of which is incorporated herein for all purposes by this reference.

BACKGROUND OF THE INVENTION

Field of the Invention

The present invention relates to an engine coolant separator and, more particularly, to an engine coolant separator and an engine cooling system having the same, capable of separating gas from an engine coolant to significantly reduce the gas in the engine coolant that circulates the engine cooling system, minimizing noise and vibrations due to cavitation.

Description of Related Art

As is well-known in the art, an engine may be maintained at an appropriate temperature by an engine coolant so that it may be stably operated.

The engine coolant (liquid) is forcefully circulated by a water pump, through a cooling circuit including an engine water jacket and an air cooled radiator.

Meanwhile, the engine coolant may be a liquid or gas depending on temperature and pressure conditions, and the gas may be generated in a specific condition of the engine coolant (for example, a condition of changing from low temperature to high temperature, and a condition of changing from high pressure to low pressure). In particular, cavitation may be caused by air bubbles generated in the engine coolant due to low pressure. As the cavitation bubbles come into contact with the water pump, the engine water jacket, and the like, they may cause noise, vibrations, and the like, resulting in wear on or damage to components.

To prevent wear or damage due to the cavitation, a structure for discharging the gas by increasing the pressure of the engine coolant or modifying the cooling system has been provided, but this may lead to increases in cost and weight.

The information included in this Background of the present invention section is only for enhancement of understanding of the general background of the present invention and may not be taken as an acknowledgement or any form of suggestion that this information forms the prior art already known to a person skilled in the art.

BRIEF SUMMARY

Various aspects of the present invention are directed to providing an engine coolant separator and an engine cooling system having the same, configured for continually separating gas from an engine coolant to thereby prevent cavitation, and thus noise, vibrations, and wear on or damage to components may be prevented, and the durability life of an engine may be increased.

According to various aspects of the present invention, an engine coolant separator may include: a housing having an inlet and an outlet; and a guide member fixedly mounted inside the housing, and having a spiral channel inducing a spiral flow of an engine coolant, wherein the spiral channel communicates with the inlet of the housing.

The spiral channel may be a spiral groove provided in an external surface of the guide member at a predetermined pitch.

According to various aspects of the present invention, an engine coolant separator may include: a housing having an inlet and an outlet; and a guide member rotatably mounted inside the housing, and having a spiral channel inducing a spiral flow of an engine coolant and a straight channel inducing a straight flow of the engine coolant to selectively inducing the spiral or straight flow of the engine coolant, wherein the guide member moves between a first operating position in which the spiral channel communicates with the inlet of the housing and a second operating position in which the straight channel communicates with the inlet of the housing.

The spiral channel may be a spiral groove provided in an external surface of the guide member at a predetermined pitch.

The straight channel may be a straight groove extending in an external surface of the guide member in a longitudinal direction of the guide member.

According to various aspects of the present invention, an engine cooling system may include: an engine water jacket provided to an engine; a radiator cooling an engine coolant discharged from the engine water jacket; a water pump forcibly circulating the engine coolant between the engine water jacket and the radiator; a coolant reservoir disposed between the engine water jacket and the radiator; and an engine coolant separator disposed between the engine water jacket and the radiator, and separating gas from the engine coolant which circulates between the radiator and the engine water jacket, wherein the engine coolant separator may include a housing having an inlet through which the engine coolant is received, and an outlet through which the engine coolant is discharged, and a guide member facilitating a spiral flow of the engine coolant which passes through the internal to the housing.

The guide member may include a spiral channel inducing the spiral flow of the engine coolant.

The guide member may further include a straight channel inducing a straight flow of the engine coolant.

The guide member may move between a first operating position in which the spiral channel communicates with the inlet of the housing and a second operating position in which the straight channel communicates with the inlet of the housing.

An outlet of the radiator may communicate with an inlet of the engine water jacket through a first coolant conduit.

The inlet of the housing may communicate with an outlet of the engine water jacket through a second coolant conduit.

The outlet of the housing may communicate with an inlet of the radiator through a third coolant conduit.

The coolant reservoir may have an inlet and an outlet, the inlet of the coolant reservoir may communicate with an inlet of the radiator through a communication conduit, and the outlet of the coolant reservoir may communicate with an inlet of the engine water jacket through a replenishing conduit.

The inlet of the coolant reservoir may be positioned in an upper end portion of the coolant reservoir.

The radiator may include a pressure cap, and the pressure cap may be connected to the coolant reservoir through a communication conduit. The pressure cap may include: a pressure valve allowing the engine coolant and the gas to flow from the radiator to the coolant reservoir when an internal pressure of the radiator is higher than a set pressure; and a negative pressure valve allowing the engine coolant to flow from the coolant reservoir to the radiator when the internal pressure of the radiator is lower than the set pressure.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
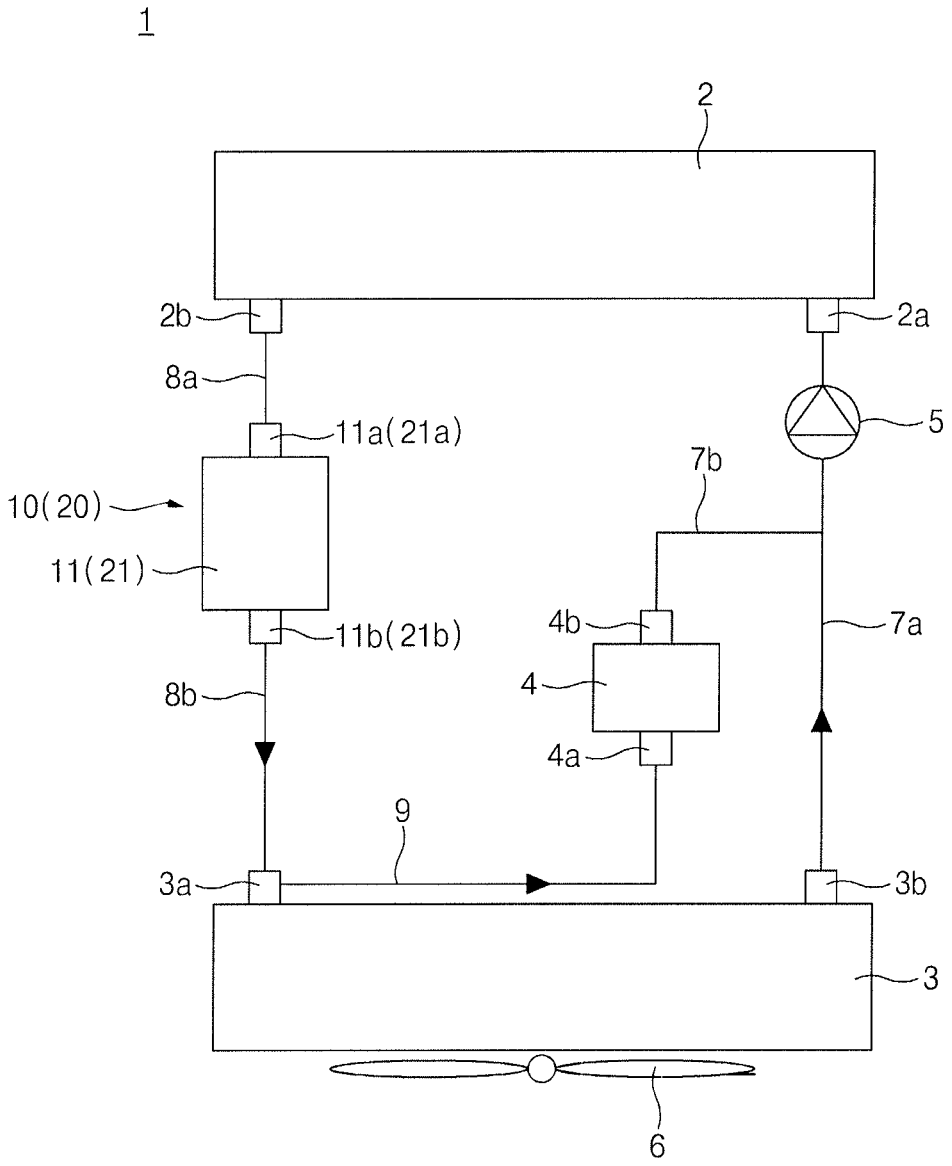
FIG. 1 illustrates a schematic view of an engine cooling system, according to an exemplary embodiment of the present invention.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

Hereinafter, various exemplary embodiments of the present invention will be described in detail with reference to the accompanying drawings. In the drawings, the same reference numerals will be used throughout to designate the same or equivalent elements. Further. Furthermore, a detailed description of well-known techniques associated with the present invention will be ruled out in order not to unnecessarily obscure the gist of the present invention.

Terms such as first, second, A, B, (a), and (b) may be used to describe the elements in exemplary embodiments of the present invention. These terms are only used to distinguish one element from another element, and the intrinsic features, sequence or order, and the like of the corresponding elements are not limited by the terms. Unless otherwise defined, all terms used herein, including technical or scientific terms, have the same meanings as those generally understood by those with ordinary knowledge in the field of art to which the present invention belongs. Such terms as those defined in a generally used dictionary are to be interpreted as having meanings equal to the contextual meanings in the relevant field of art, and are not to be interpreted as having ideal or excessively formal meanings unless clearly defined as having such in the present application.

Referring to FIG. 1, an engine cooling system 1 may include an engine water jacket 2, a radiator 3, a coolant reservoir 4, a water pump 5, and an engine coolant separator 10.

The water pump 5 may be configured to forcibly circulate an engine coolant between the radiator 3 and the engine water jacket 2. The engine water jacket 2 may be provided to a cylinder block and a cylinder head of an engine. The engine water jacket 2 may have an inlet 2*a* through which the engine coolant is received, and an outlet 2*b* through which the engine coolant is discharged. As the engine coolant passes through the engine water jacket 2, it may cool the engine. The radiator 3 may have an inlet 3*a* through which the engine coolant is received, and an outlet 3*b* through which the engine coolant is discharged, and the radiator 3 may be configured to cool the engine coolant by a cooling fan 6. The coolant reservoir 4 may have an inlet 4*a* through which the engine coolant is received, and an outlet 4*b* through which the engine coolant is discharged, and the coolant reservoir 4 may store the engine coolant.

The inlet 2*a* of the engine water jacket 2 may communicate with the outlet 3*b* of the radiator 3 through a first coolant conduit 7*a*.

The inlet 3*a* of the radiator 3 may communicate with the inlet 4*a* of the coolant reservoir 4 through a communication conduit 9.

The outlet 4*b* of the coolant reservoir 4 may communicate with the first coolant conduit 7*a* through a replenishing conduit 7*b* so that the outlet 4*b* of the coolant reservoir 4 may communicate with the inlet 2*a* of the engine water jacket 2. Thus, the coolant reservoir 4 and the radiator 3 may be connected to the engine water jacket 2 in parallel. The coolant may be replenished from the coolant reservoir 4 to the engine water jacket 2 through the replenishing conduit 7*b* and the first coolant conduit 7*a*.

The engine coolant separator 10 may be disposed between the outlet 2*b* of the engine water jacket 2 and the inlet 3*a* of the radiator 3 so that it may be configured to separate gas from the engine coolant from the outlet 2*b* of the engine water jacket 2.

Figure 2:
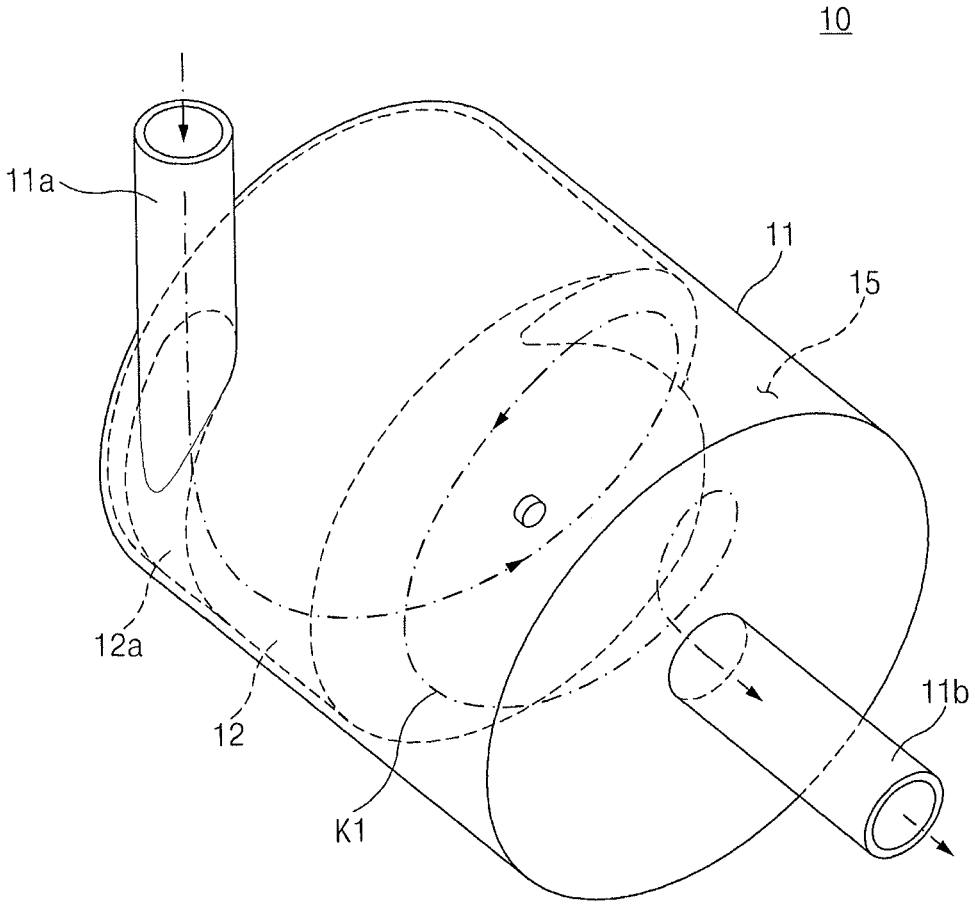
FIG. 2 illustrates a perspective view of an engine coolant separator, according to various exemplary embodiments of the present invention.
Figure 3:
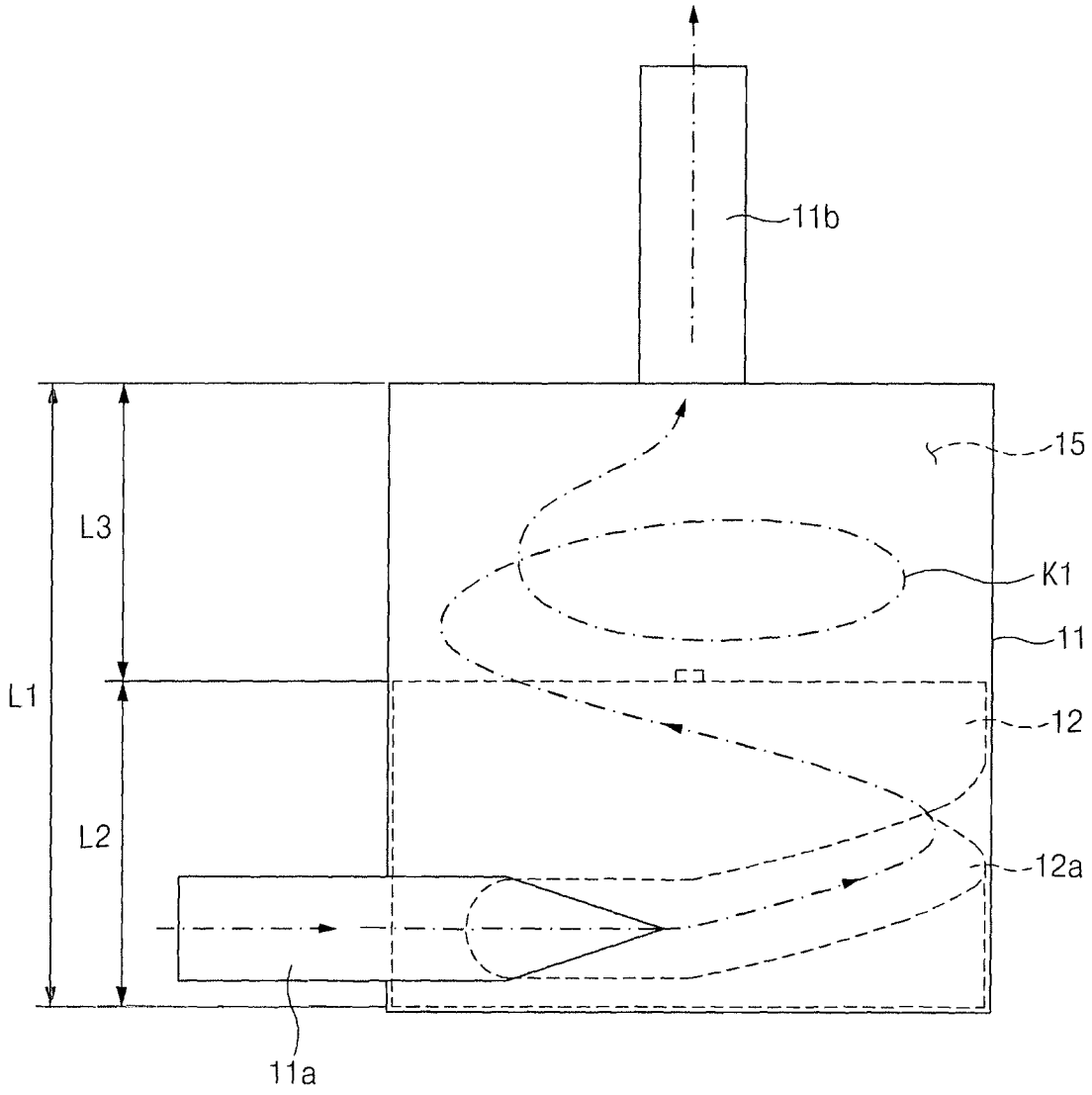
FIG. 3 illustrates a front view of the engine coolant separator, according to the various exemplary embodiments of the present invention.

As illustrated in FIG. 2 and FIG. 3, the engine coolant separator 10, according to various exemplary embodiments of the present invention, may include a housing 11, and a guide member 12 disposed in the housing 11.

The housing 11 may be a circular cylinder. The housing 11 may have an inlet 11*a* through which the engine coolant is received, and an outlet 11*b* through which the engine coolant is discharged so that the engine coolant may pass through the internal of the housing 11.

The inlet 11*a* may be located tangentially to the housing 11, and the outlet 11*b* may be disposed along a longitudinal axis of the housing 11 or parallel to the longitudinal axis of the housing 11.

The inlet 11*a* of the housing 11 may communicate with the outlet 2*b* of the engine water jacket 2 through a second coolant conduit 8*a*, and the inlet 11*a* of the housing 11 may receive the engine coolant which is discharged from the outlet 2*b* of the engine water jacket 2.

The outlet 11*b* of the housing 11 may communicate with the inlet 3*a* of the radiator 3 through a third coolant conduit 8*b*, and the inlet 3*a* of the radiator 3 may receive the engine coolant which is discharged from the outlet 11*b* of the housing 11.

The guide member 12 may be a solid cylinder, and be fixedly mounted in the housing 11. The guide member 12 may have a spiral channel 12*a* inducing a spiral flow of the engine coolant. The spiral channel 12*a* may have the shape of a spiral groove formed in an external surface of the guide member 12 at a predetermined pitch, and as the engine coolant moves through the spiral channel 12*a*, the spiral flow of the engine coolant may be induced.

The guide member 12 may have a length L2 which is less than a length L1 of the housing 11. As the guide member 12 is disposed adjacent to the inlet 11*a* of the housing 11, a cavity 15 may be formed in a section adjacent to the outlet 11*b* of the housing 11. The cavity 15 of the housing 11 may have a length L3 (L3=L1−L2) obtained by subtracting the length L2 of the guide member 12 from the length L1 of the housing 11.

One end portion of the spiral channel 12*a* may directly communicate with the inlet 11*a* of the housing 11, and the other end portion of the spiral channel 12*a* may directly communicate with the cavity 15.

Figure 4:
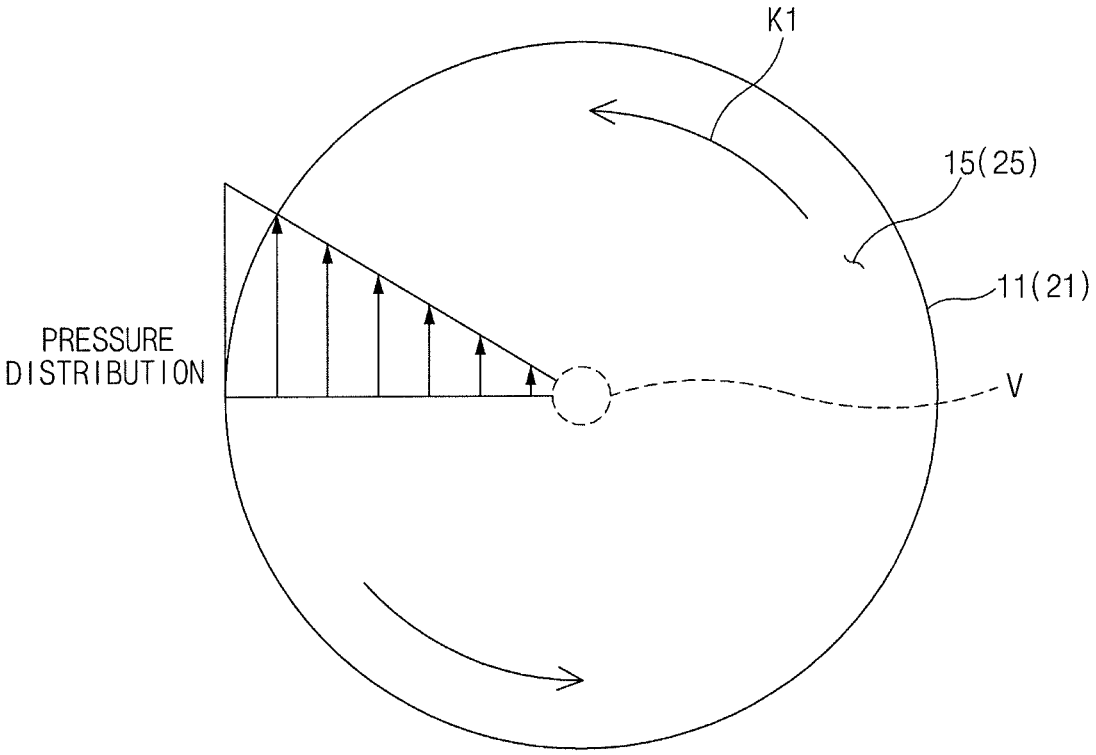
FIG. 4 illustrates cavitation in an engine coolant when a spiral flow of the engine coolant is induced in an engine coolant separator, according to an exemplary embodiment of the present invention.

As the engine coolant introduced through the inlet 11*a* of the housing 11 moves through the spiral channel 12*a*, the spiral flow of the engine coolant may be induced. Due to the spiral flow of the engine coolant, the engine coolant may be subjected to higher pressure in an external section of the cavity 15 and lower pressure in a central section V of the cavity 15 by a centrifugal force as illustrated in FIG. 4. After the gas dissolved in the engine coolant is separated from the engine coolant by a difference in the pressures, it may be collected in the central section V of the cavity 15. The central section V of the cavity 15 may be a gas collection section for collecting the gas separated by the spiral flow of the engine coolant. The gas collected in the central section V of the cavity 15, together with the liquid engine coolant, may be discharged through the outlet 11*b* of the housing 11.

Figure 5:
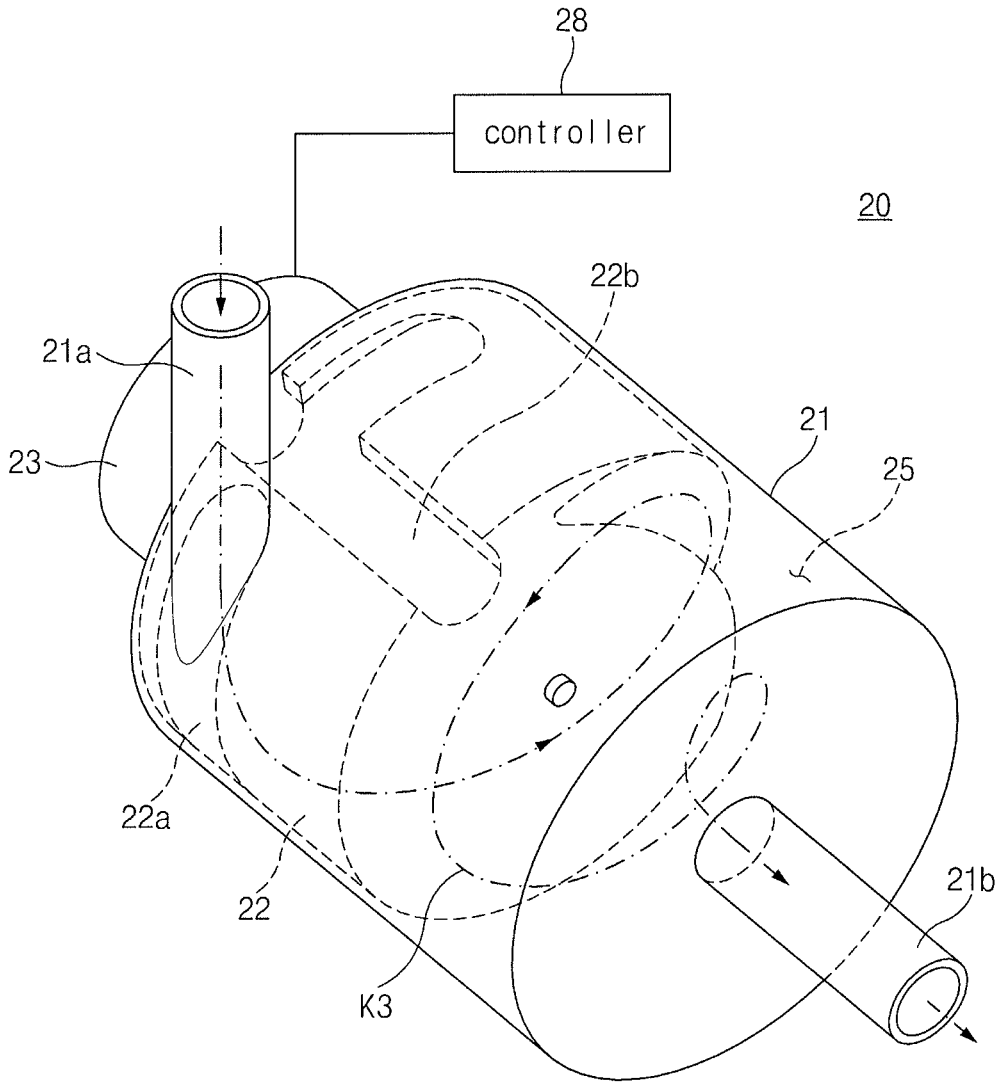
FIG. 5 illustrates a perspective view of an engine coolant separator in a state in which a guide member is moved to a first operating position, according to various exemplary embodiments of the present invention.
Figure 6:
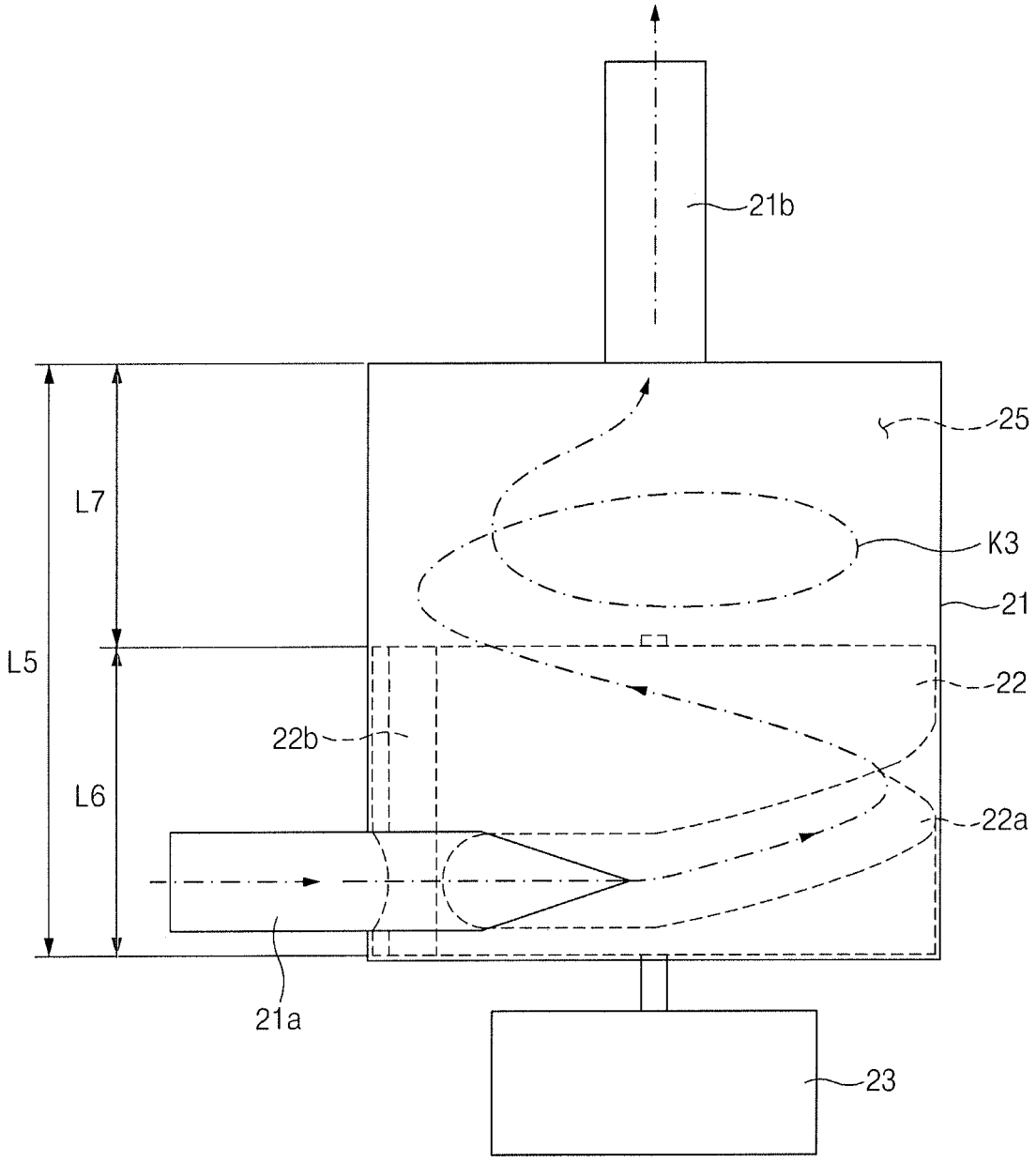
FIG. 6 illustrates a front view of the engine coolant separator in the state in which the guide member is moved to the first operating position, according to the various exemplary embodiments of the present invention.
Figure 7:
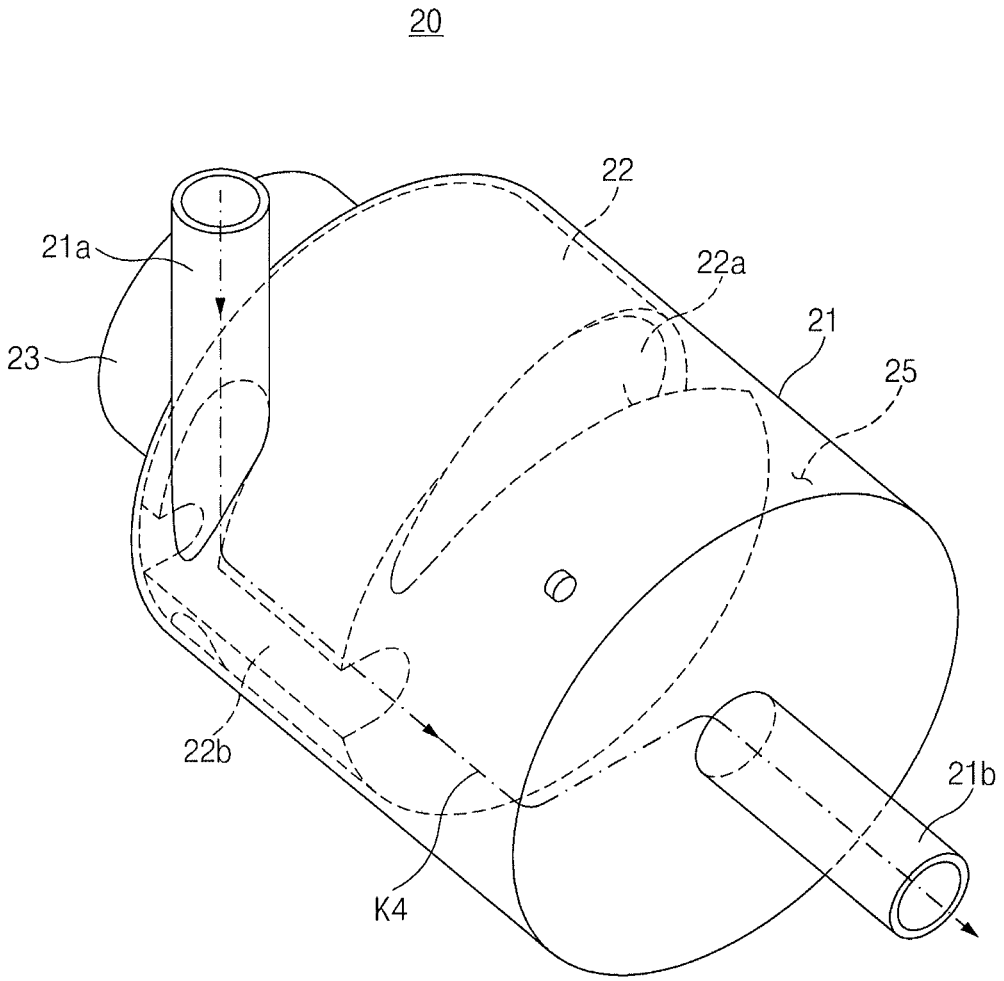
FIG. 7 illustrates a perspective view of the engine coolant separator in a state in which the guide member is moved to a second operating position, according to the various exemplary embodiments of the present invention.
Figure 8:
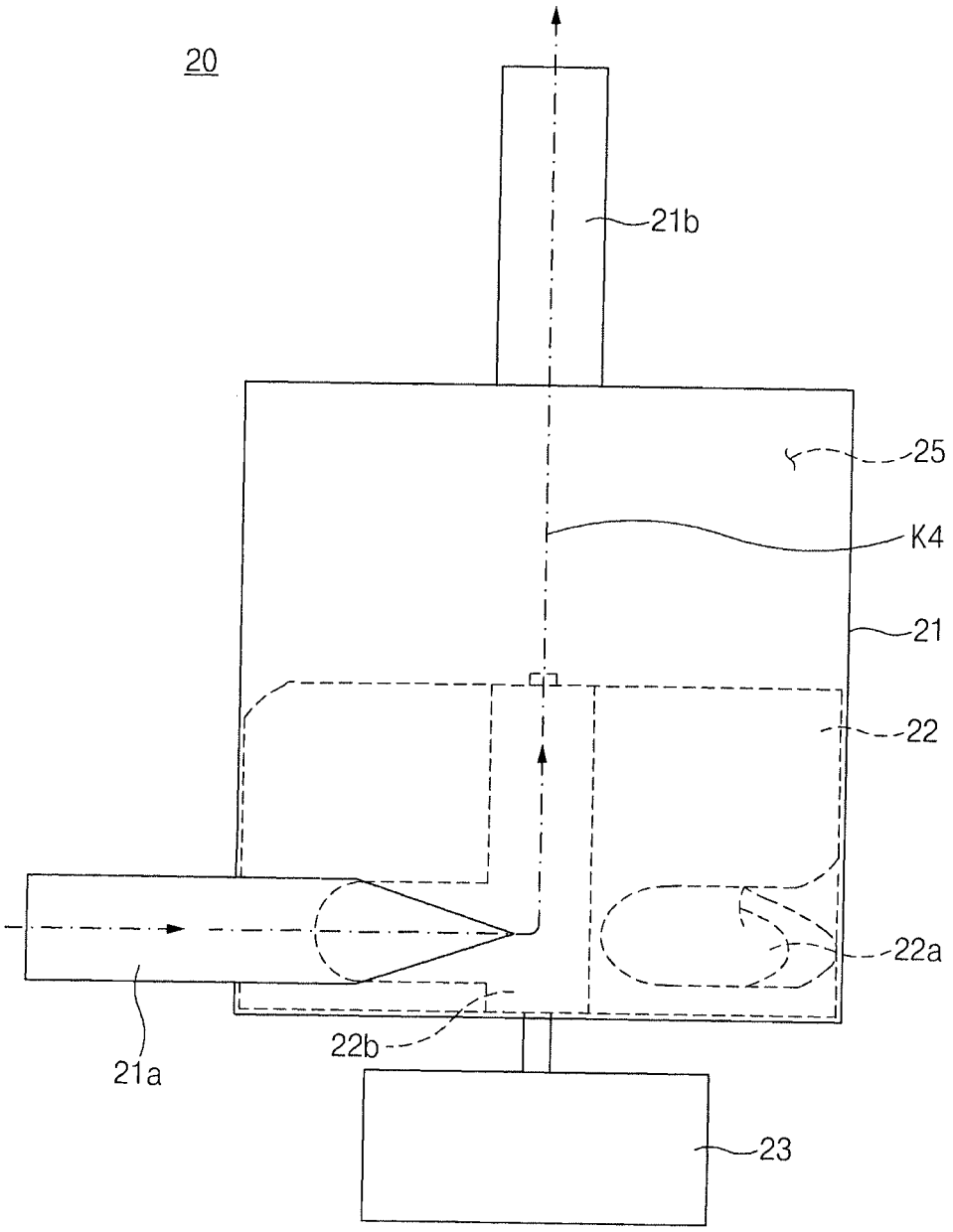
FIG. 8 illustrates a front view of the engine coolant separator in the state in which the guide member is moved to the second operating position, according to the various exemplary embodiments of the present invention.

As illustrated in FIGS. 5, 6, 7 and 8, an engine coolant separator 20, according to various exemplary embodiments of the present invention, may include a housing 21, and a guide member 22 moving in the housing 21 between a first operating position (see FIG. 5 and FIG. 6) and a second operating position (see FIGS. 7 and 8).

The housing 21 may be a circular cylinder. The housing 21 may have an inlet 21*a* through which the engine coolant is received, and an outlet 21*b* through which the engine coolant is discharged.

The inlet 21*a* may be located tangentially to the housing 21, and the outlet 21*b* may be disposed along a longitudinal axis of the housing 21 or parallel to the longitudinal axis of the housing 21.

The inlet 21*a* of the housing 21 may communicate with the outlet 2*b* of the engine water jacket 2 through the second coolant conduit 8*a* such that the inlet 21*a* of the housing 21 may receive the engine coolant which is discharged from the outlet 2*b* of the engine water jacket 2.

The outlet 21*b* of the housing 21 may communicate with the inlet 3*a* of the radiator 3 through the third coolant conduit 8*b* such that the inlet 3*a* of the radiator 3 may receive the engine coolant which is discharged from the outlet 21*b* of the housing 21.

The guide member 22 may be a solid cylinder, and be rotatably mounted in the housing 21. The guide member 22 may have a spiral channel 22*a* inducing a spiral flow of the engine coolant, and a straight channel 22*b* inducing a straight flow of the engine coolant.

The spiral channel 22*a* may have the shape of a spiral groove formed in the external surface of the guide member 22 at a predetermined pitch, and as the engine coolant moves through the spiral channel 22*a*, the spiral flow of the engine coolant may be induced.

The straight channel 22*b* may have the shape of a straight groove extending in the external surface of the guide member 22 in a longitudinal direction of the guide member 22, and as the engine coolant moves through the straight channel 22*b*, the straight flow of the engine coolant may be induced.

The guide member 22 may have a length L6 which is less than a length L5 of the housing 21. As the guide member 22 is disposed adjacent to the inlet 21*a* of the housing 21, a cavity 25 may be formed in a section adjacent to the outlet 21*b* of the housing 21. The cavity 25 of the housing 21 may have a length L7 (L7=L5−L6) obtained by subtracting the length L6 of the guide member 22 from the length L5 of the housing 21.

The guide member 22 may be rotatable by an actuator 23 such as a motor such that the guide member 22 may be moved by the actuator 23 between the first operating position (see FIG. 5 and FIG. 6) and the second operating position (see FIGS. 7 and 8).

The actuator 23 may be electrically connected to a controller 28, and the controller 28 may control the driving of the actuator 23 according to the operation conditions and the like of the engine. The controller 28 may include a microprocessor or a central processing unit, a read only memory (ROM), a random access memory (RAM), an electrically programmable read only memory (EPROM), and a high speed clock.

As illustrated in FIG. 5 and FIG. 6, the first operating position may be a position in which the inlet 21*a* of the housing 21 directly communicates with one end portion of the spiral channel 22*a*.

When a relatively large amount of gas is dissolved in the engine coolant as a driving time of the engine has elapsed for a predetermined time period or when the flow rate of the engine coolant is increased as in a high RPM region of the engine, the actuator 23 may move the guide member 22 to the first operating position by the controller 28, such that one end portion of the spiral channel 22*a* may directly communicate with the inlet 21*a* of the housing 21, and the other end portion of the spiral channel 22*a* may directly communicate with the cavity 25. As the engine coolant introduced through the inlet 21*a* of the housing 21 moves through the spiral channel 22*a*, the spiral flow of the engine coolant may be induced.

Due to the spiral flow of the engine coolant, the engine coolant may be subjected to higher pressure in an external section of the cavity 25 and lower pressure in a central section V of the cavity 25 by the centrifugal force as illustrated in FIG. 4. After the gas dissolved in the engine coolant is separated from the engine coolant by a difference in the pressures, it may be collected in the central section V of the cavity 25. The central section V of the cavity 25 may be a gas collection section for collecting the gas separated by the spiral flow of the engine coolant. The gas collected in the central section V of the cavity 25, together with the liquid engine coolant, may be discharged through the outlet 21*b* of the housing 21.

As illustrated in FIGS. 7 and 8, the second operating position may be a position in which the inlet 21*a* of the housing 21 communicates with one end portion of the straight channel 22*b*.

When a relatively small amount of gas is dissolved in the engine coolant such as initial starting of the engine, when the flow rate of the engine coolant is relatively reduced as in a low RPM region of the engine, or when the engine needs rapid cooling due to overload, the actuator 23 may move the guide member 22 to the second operating position by the controller 28 as illustrated in FIGS. 7 and 8, such that one end portion of the straight channel 22*b* may directly communicate with the inlet 21*a* of the housing 21, and the other end portion of the straight channel 22*b* may directly communicate with the cavity 25. As the engine coolant introduced through the inlet 21*a* of the housing 21 moves through the straight channel 22*b*, the straight flow of the engine coolant may be induced.

Meanwhile, by selective control or design modification of the channels 12*a*, 22*a* and 22*b* of the guide member 12 or 22 in the engine coolant separator 10 or 20, which replaces a conventional thermostat, a conventional coolant control valve, and the like, the engine coolant may be selectively distributed to the engine, a heating device, the radiator, and the like.

Figure 9:
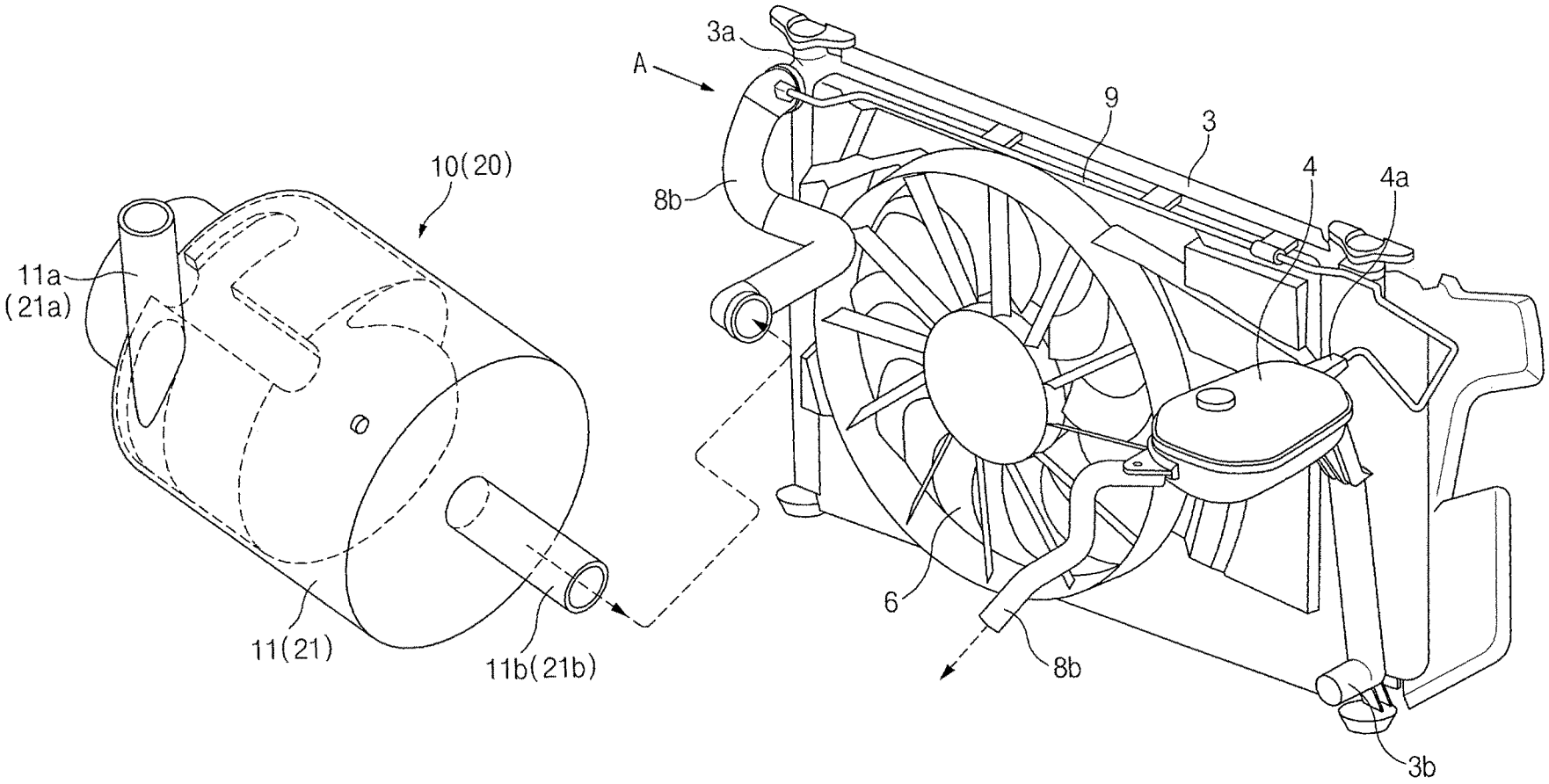
FIG. 9 illustrates a perspective view of a structure in which an engine coolant separator is connected to a radiator and a coolant reservoir, according to an exemplary embodiment of the present invention.
Figure 10:
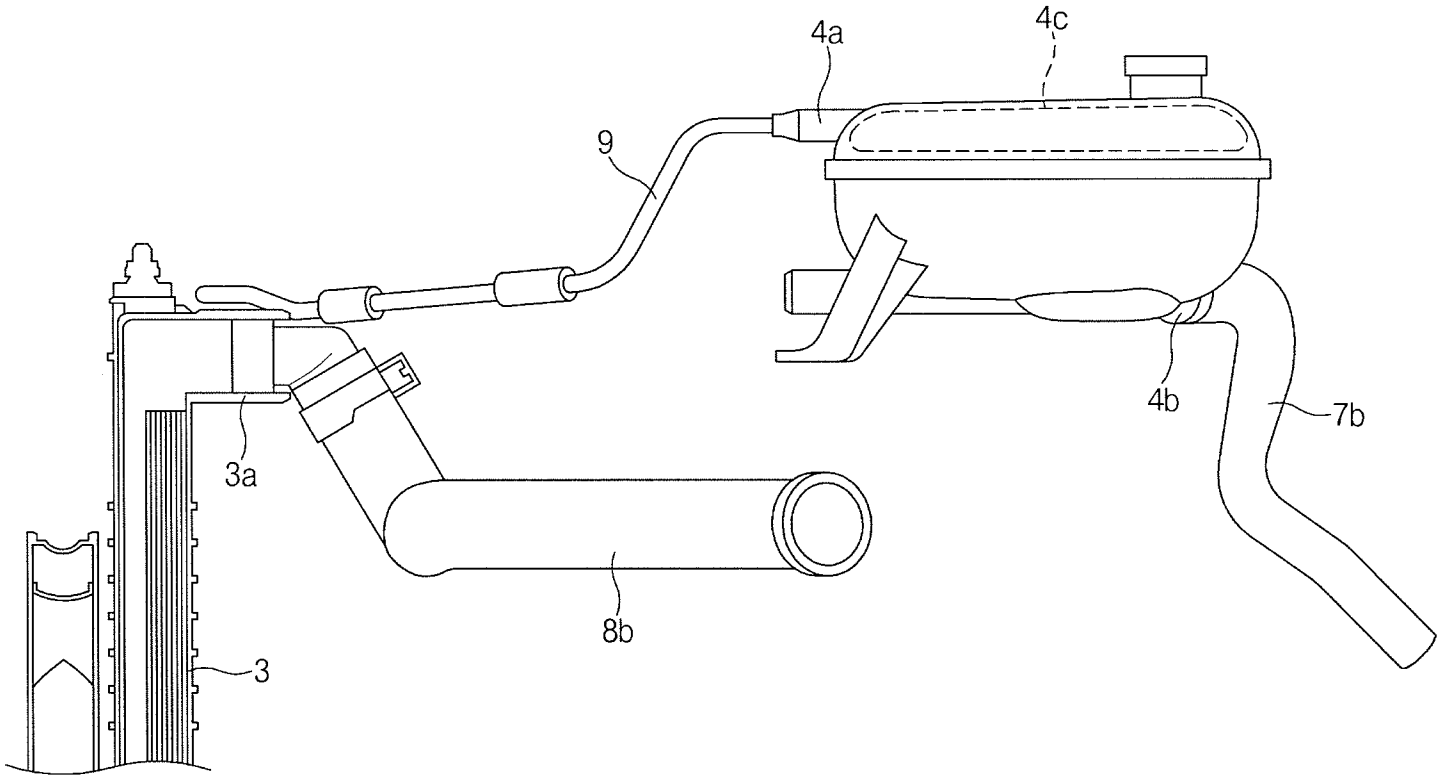
FIG. 10 illustrates a view of the structure illustrated in FIG. 9, when viewed in a direction of arrow A.

As illustrated in FIG. 9 and FIG. 10, the gas separated from the engine coolant separator 10 or 20, together with the engine coolant, may pass through the communication conduit 9, and enter the inlet 4*a* of the coolant reservoir 4.

When the gas separated by the spiral groove 12*a* or 22*a* of the engine coolant separator 10 or 20, together with the engine coolant, flows into the inlet 3*a* of the radiator 3, the gas may be separated from the engine coolant due to a density difference in the inlet 3*a* of the radiator 3, and the separated gas may pass through the communication conduit 9, and be introduced into the inlet 4*a* of the coolant reservoir 4.

In the engine cooling system 1 according to the exemplary embodiment illustrated in FIG. 1, the coolant reservoir 4 may be closed by a pressure cap, and no pressure cap may be mounted on the radiator 3. Thus, the engine cooling system 1 in FIG. 1 may allow a coolant pressure to be maintained at a set pressure higher than an atmospheric pressure, and the gas separated from the engine coolant separator 10 by the set pressure, together with the engine coolant, may pass through the communication conduit 9, and be transferred to the coolant reservoir 4. In the engine cooling system 1 of FIG. 1, the communication conduit 9 may be a degassing conduit for conveying the gas from the radiator 3 to the coolant reservoir 4, and the coolant reservoir 4 may be a degassing container for storing the gas and the engine coolant.

The inlet 3*a* of the radiator 3 may be connected to the inlet 4*a* of the coolant reservoir 4 through the communication conduit 9. The inlet 4*a* may be disposed in an upper end portion of the coolant reservoir 4 so that the gas received in the coolant reservoir 4 may be separated from the engine coolant by the density difference, and be collected in an upper space 4*c* of the coolant reservoir 4.

The outlet 4*b* of the coolant reservoir 4 may communicate with the first coolant conduit 7*a* through the replenishing conduit 7*b*. The outlet 4*b* of the coolant reservoir 4 may communicate with the inlet 2*a* of the engine water jacket 2 through the replenishing conduit 7*b* and the first coolant conduit 7*a* so that the engine coolant received in the coolant reservoir 4 may be replenished to the engine water jacket 2 through the replenishing conduit 7*b* and the first coolant conduit 7*a*.

Meanwhile, the engine coolant separator 10 may separate the gas from the engine coolant periodically and continuously, and accordingly the amount of gas separated from the engine coolant may be greater than the amount of gas dissolved in the engine coolant, and the amount of gas in the engine coolant may be minimized.

After the engine coolant in a pure liquid state from which the gas is separated in the inlet 3*a* of the radiator 3 passes through an internal channel of the radiator 3, it may pass through the first coolant conduit 7*a* and enter the inlet 2*a* of the engine water jacket 2.

The engine coolant received in a lower space of the coolant reservoir 4 may be replenished to the first coolant conduit 7*a* through the replenishing conduit 7*b*, and the replenished engine coolant may be recirculated by the water pump 5.

Figure 11:
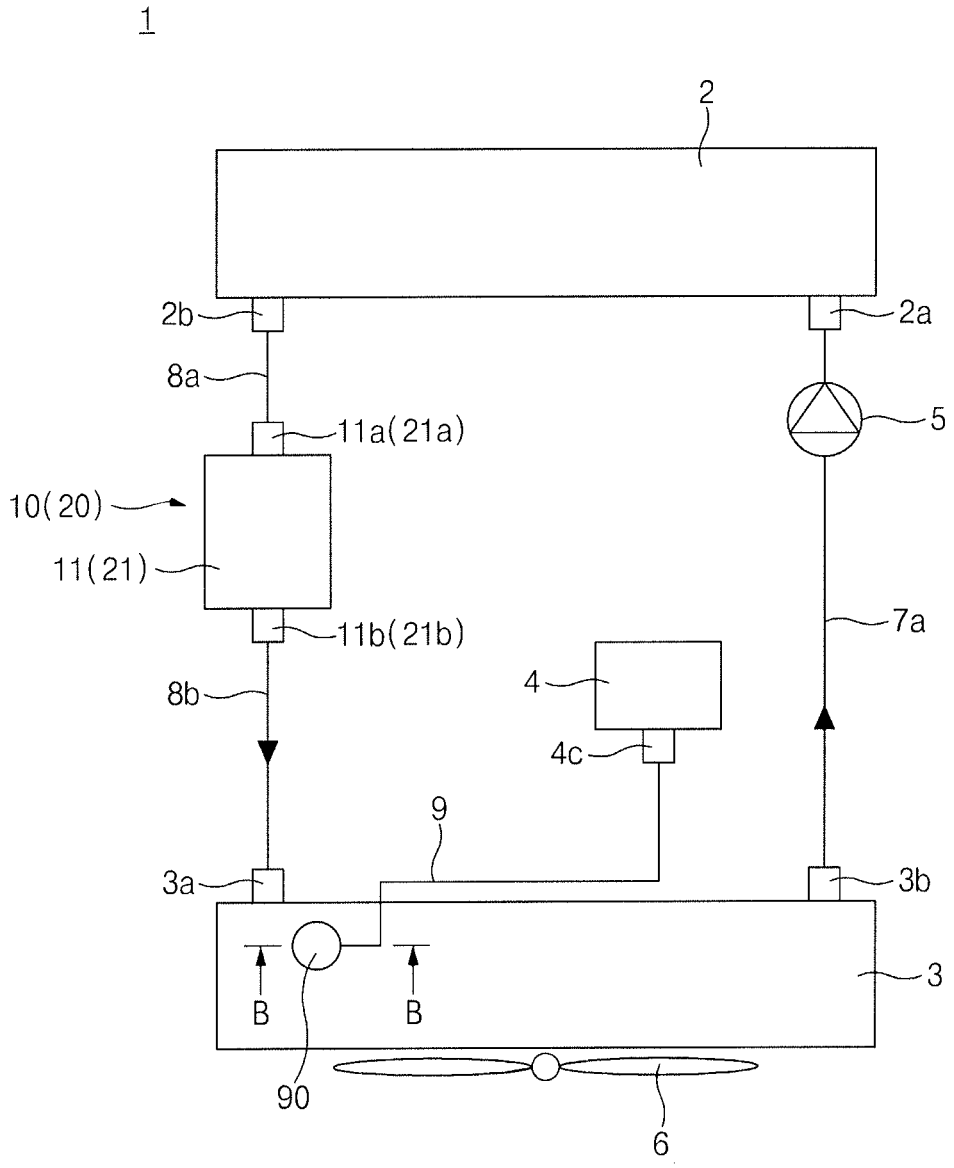
FIG. 11 illustrates a schematic view of an engine cooling system, according to another exemplary embodiment of the present invention.

FIG. 11 illustrates an engine cooling system according to another exemplary embodiment of the present invention.

The engine cooling system 1 in FIG. 11 may further include a pressure cap 90 mounted on an end portion of the radiator 3, and the coolant reservoir 4 may be opened to the outside so that an internal pressure of the coolant reservoir 4 may be similar to the atmospheric pressure. The engine cooling system 1 in FIG. 11 may allow a coolant pressure to be maintained at a set pressure similar to the atmospheric pressure by the pressure cap 90. The coolant reservoir 4 may have a single port 4*c* through which the engine coolant and the gas are received or the engine coolant is discharged.

The pressure cap 90 may be connected to the port 4*c* of the coolant reservoir 4 through the communication conduit 9, and the gas separated by the engine coolant separator 10 or 20, together with the engine coolant, may pass through the communication conduit 9 and enter the coolant reservoir 4. In other words, the radiator 3 may communicate with the coolant reservoir 4 through the pressure cap 90 and the communication conduit 9.

Figure 12:
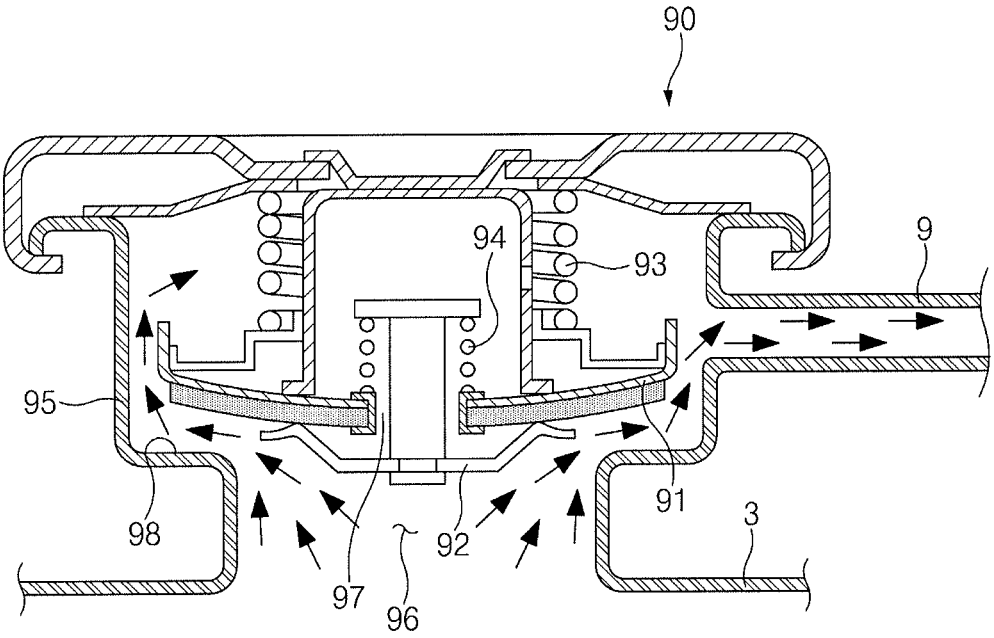
FIG. 12 illustrates a cross-sectional view of a radiator and a pressure cap, taken along line B-B of FIG. 11, in a state in which an internal pressure of the radiator is higher than a set pressure.
Figure 13:
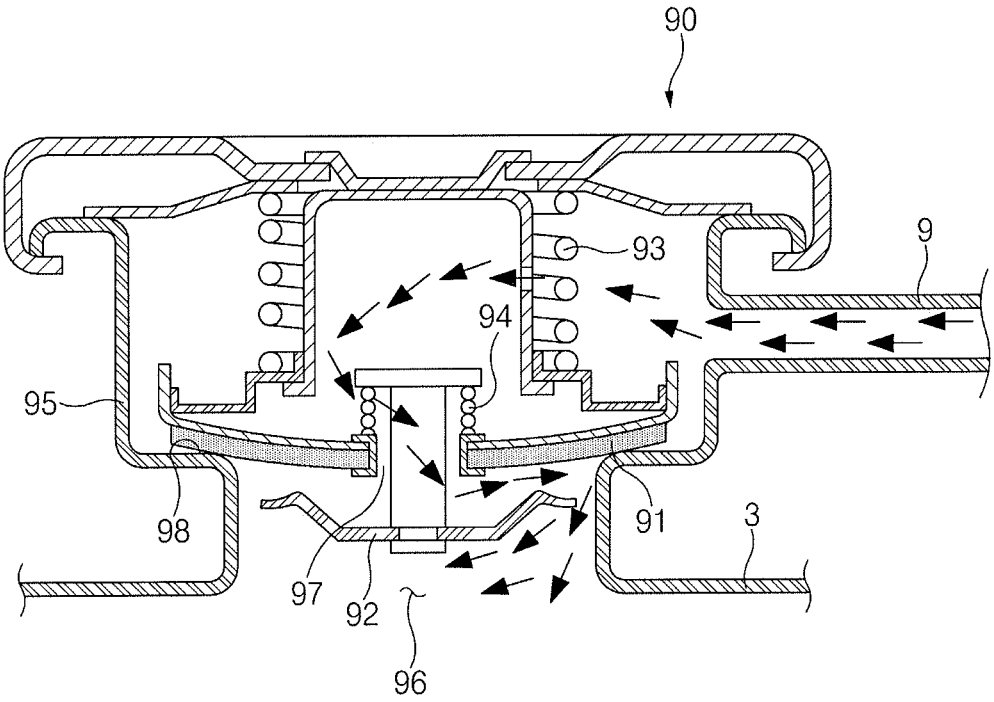
FIG. 13 illustrates a cross-sectional view of the radiator and the pressure cap, taken along line B-B of FIG. 11, in a state in which the internal pressure of the radiator is lower than the set pressure.

As illustrated in FIG. 12, and FIG. 13, the top end portion of the radiator 3 may be provided with a neck 95 having an opening 96 and a valve seat 98, and the pressure cap 90 may be mounted in the neck 95. A. An opening 97 may be formed in the center of the pressure cap 90. The pressure cap 90 may include a pressure valve 91 allowing the engine coolant and the gas to flow from the radiator 3 to the coolant reservoir 4 when the internal pressure of the radiator 3 is higher than the set pressure, and a negative pressure valve 92 allowing the engine coolant to flow from the coolant reservoir 4 to the radiator 3 when the internal pressure of the radiator 3 is lower than the set pressure.

The pressure valve 91 may move inside the neck 95 in a vertical direction such that it may contact or be spaced from the valve seat 98 of the neck 95. The pressure valve 91 may have the opening in the center thereof. A first elastic member 93 may be configured to urge the pressure valve 91 downwardly.

The negative pressure valve 92 may be mounted in the opening 97 of the pressure valve 91 to be movable upwards and downwards. A second elastic member 94 may be configured to urge the negative pressure valve 92 upwardly.

As illustrated in FIG. 12, when the internal pressure of the radiator 3 is higher than the set pressure, the internal pressure of the radiator 3 is higher than the internal pressure of the coolant reservoir 4, and accordingly the first elastic member 93 may be compressed upwardly. Thus, the pressure valve 91 may be spaced from the valve seat 98 of the neck 95, and the negative pressure valve 92 may be brought into contact with the pressure valve 91 to thereby close the opening 97 of the pressure valve 91. The radiator 3 and the coolant reservoir 4 may communicate with each other through the communication conduit 9, and the engine coolant and the gas may flow from the radiator 3 into the coolant reservoir 4.

As illustrated in FIG. 13, when the internal pressure of the radiator 3 is lower than the set pressure, the pressure valve 91 may be brought into contact with the valve seat 98 of the neck 95 by the elastic force of the first elastic member 93. Since the internal pressure of the coolant reservoir 4 is higher than the internal pressure of the radiator 3, the second elastic member 94 may be compressed downwardly. As the second elastic member 94 is compressed downwardly, the negative pressure valve 92 may be spaced from the pressure valve 91, and the opening 97 of the pressure valve 91 may be opened, and thus the engine coolant received in the coolant reservoir 4 may flow into the radiator 3 (i.e., replenishment of the engine coolant).

According to the above-described exemplary embodiments of the present invention, cavitation may be prevented by continuously separating the gas from the engine coolant circulating in the engine cooling system, and thus noise, vibrations, and wear on or damage to components may be prevented, and the durability life of the engine may be increased.

Furthermore, by continuously separating the gas from the engine coolant, the pressure in the cooling system may be lowered compared to that in a conventional pressurized cooling system, and thus the cost and weight of the cooling system may be reduced.

By the selective control or design modification of the channels of the guide member, which replaces a conventional thermostat, a conventional coolant control valve, and the like, the engine coolant may be selectively distributed to the engine, the heating device, the radiator, and the like.

The present inventive concept may be easily applied not to an engine cooling system of a vehicle with an internal combustion engine but also to an engine cooling system of an environmentally friendly vehicle (an electric vehicle, a hybrid vehicle, etc.).

As set forth above, the engine coolant separator and the engine cooling system having the same can continuously separate the gas from the engine coolant to thereby prevent the cavitation, and thus noise, vibrations, and wear on or damage to components may be prevented, and the durability life of the engine may be extended.

Furthermore, the engine coolant separator and the engine cooling system having the same can continuously separate the gas from the engine coolant, lowering the pressure in the cooling system, compared to that in a conventional pressurized cooling system, and thus the cost and weight of the cooling system may be reduced.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. An engine coolant separator comprising:

a housing having an inlet and an outlet; and a guide member rotatably mounted inside the housing, and having:

a spiral channel inducing a spiral flow of an engine coolant; and a straight channel inducing a straight flow of the engine coolant for selectively inducing the spiral flow or the straight flow of the engine coolant, wherein the guide member selectively moves between a first operating position in which the spiral channel communicates with the inlet of the housing and a second operating position in which the straight channel communicates with the inlet of the housing according to rotation of the guide member.

2. The engine coolant separator according to claim 1, wherein the spiral channel is a spiral groove provided in an external surface of the guide member at a predetermined pitch.

3. The engine coolant separator according to claim 1, wherein the straight channel is a straight groove extending in an external surface of the guide member in a longitudinal direction of the guide member.

4. An engine cooling system comprising:

an engine water jacket provided to an engine;

a radiator cooling an engine coolant discharged from the engine water jacket;

a water pump connected between the engine water jacket and the radiator and circulating the engine coolant between the engine water jacket and the radiator;

a coolant reservoir disposed between the engine water jacket and the radiator; and an engine coolant separator connected between the engine water jacket and the radiator, and separating gas from the engine coolant which circulates between the radiator and the engine water jacket, wherein the engine coolant separator includes:

a housing having an inlet connected to the engine water jacket, wherein the engine coolant is supplied into the inlet of the housing, and an outlet connected to the radiator, wherein the engine coolant is discharged through the outlet of the housing; and a guide member mounted in the housing and facilitating a spiral flow of the engine coolant which passes through the internal to the housing, wherein the guide member includes a spiral channel inducing the spiral flow of the engine coolant, and a straight channel inducing a straight flow of the engine coolant, and wherein the guide member is rotatably mounted inside of the housing and selectively moves between a first operating position in which the spiral channel communicates with the inlet of the housing and a second operating position in which the straight channel communicates with the inlet of the housing, according to a rotation of the guide member.

5. The engine cooling system according to claim 4, wherein an outlet of the radiator communicates with an inlet of the engine water jacket through a first coolant conduit.

6. The engine cooling system according to claim 4, wherein the inlet of the housing communicates with an outlet of the engine water jacket through a second coolant conduit.

7. The engine cooling system according to claim 4, wherein the outlet of the housing communicates with an inlet of the radiator through a third coolant conduit.

8. The engine cooling system according to claim 4, wherein the coolant reservoir has an inlet and an outlet, the inlet of the coolant reservoir communicates with an inlet of the radiator through a communication conduit, and the outlet of the coolant reservoir communicates with an inlet of the engine water jacket through a replenishing conduit.

9. The engine cooling system according to claim 8, wherein an outlet of the radiator communicates with an inlet of the engine water jacket through a first coolant conduit, and wherein the outlet of the coolant reservoir communicates with the inlet of the engine water jacket through the replenishing conduit connected to the first coolant conduit.

10. The engine cooling system according to claim 8, wherein the inlet of the coolant reservoir is disposed in an upper end portion of the coolant reservoir.

11. The engine cooling system according to claim 4, wherein the coolant reservoir includes a port, wherein the radiator includes a pressure cap, and wherein the pressure cap is connected to the port of the coolant reservoir through a communication conduit.

12. The engine cooling system according to claim 11, wherein the pressure cap includes:

a first pressure valve allowing the engine coolant and the gas to flow from the radiator to the coolant reservoir when an internal pressure of the radiator is higher than a set pressure; and a second pressure valve allowing the engine coolant to flow from the coolant reservoir to the radiator when the internal pressure of the radiator is lower than the set pressure.

13. The engine cooling system according to claim 12, wherein the pressure cap configured to be mounted to a neck, further includes:

an opening formed in the first pressure valve, wherein the second pressure valve is slidably coupled to the first pressure valve through the opening;

a first elastic member engaged to the first pressure valve and elastically biasing the first pressure valve to a first direction; and a second elastic member engaged to the second pressure valve and elastically biasing the second pressure valve to a second direction.

* * * * *